United States Patent [19]

Stalter

[11] 4,010,577

[45] Mar. 8, 1977

[54] ROOF DRAIN SYSTEM

[76] Inventor: Gordon R. Stalter, 511 NE. 2nd St., Hopedale, Ill. 61747

[22] Filed: May 3, 1976

[21] Appl. No.: 682,332

[52] U.S. Cl. ..... 52/1; 52/11; 98/36

[51] Int. Cl.[2] ..... E04H 9/00

[58] Field of Search ..... 52/11, 1, 173; 98/30, 98/36

[56] References Cited

UNITED STATES PATENTS

| | | | |
|---|---|---|---|
| 3,123,988 | 3/1964 | Richmam | 98/36 X |
| 3,233,078 | 2/1966 | Siemianowski | 219/213 |
| 3,582,612 | 6/1971 | Siemianowski | 219/213 |
| 3,860,236 | 1/1975 | Buchanan | 98/36 X |

*Primary Examiner*—Price C. Faw, Jr.
*Assistant Examiner*—Carl D. Friedman
*Attorney, Agent, or Firm*—Morsbach & Pillote

[57] ABSTRACT

A roof drain system in which an air duct is mounted on a building to extend along the lower edge of the roof to have the water from the roof flow thereover, a blower communicates with the air duct to supply air under above atomspheric pressure thereto, and the duct has apertures along the length thereof for passing air in jets directed laterally outwardly of the building to substantially disrupt the water into droplets as it flows across the air duct and thereby distribute the droplets in a wide band outwardly of the roof line of the building. Apparatus for automatically operating the blower means when it rains, is advantageously provided.

8 Claims, 5 Drawing Figures

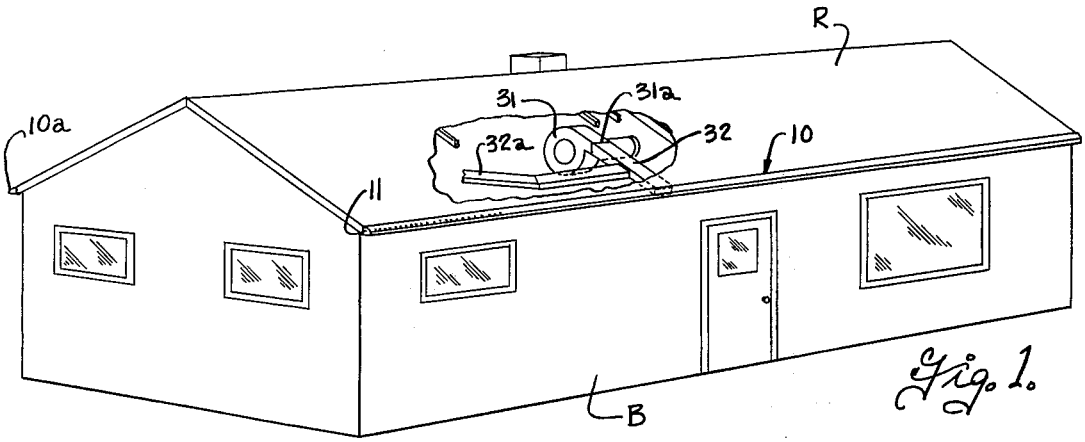
Fig. 1.
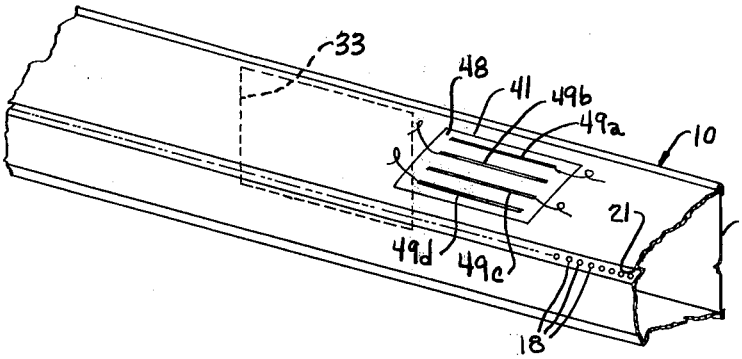
Fig. 2.
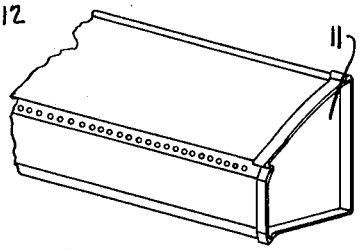
Fig. 3.
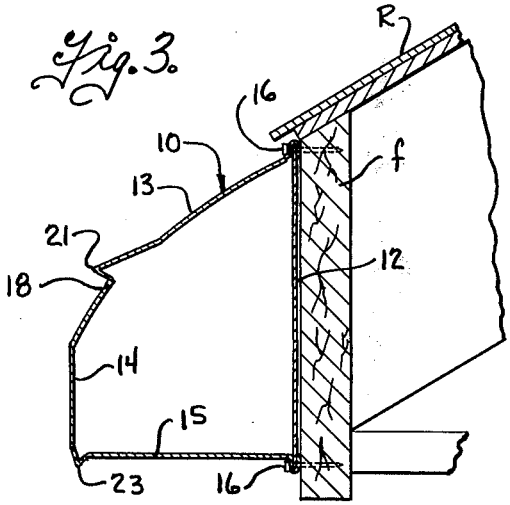
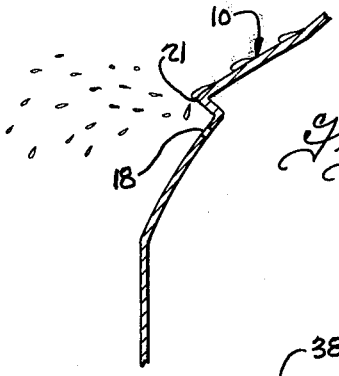
Fig. 4.
Fig. 5.
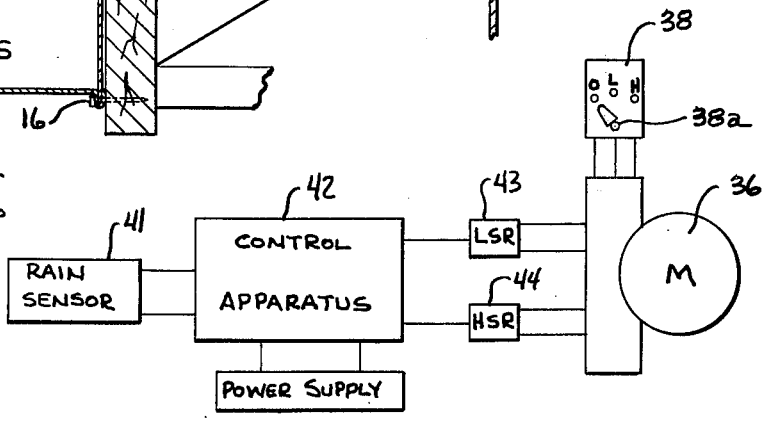

ROOF DRAIN SYSTEM

BACKGROUND OF THE INVENTION

It is a common practice to provide eaves troughs at the lower edge of the roof to collect the rain water that runs off the roof. Such eaves troughs, however, have a number of disadvantages. The eaves troughs require downspouts to convey the water from the roof line to ground level and the downspouts adversely effect the appearance of the building. Moreover, the downspouts deliver the water in a highly concentrated stream and, if they discharge the rain water at the surface of the ground, the concentrated discharge of the rain water can cause ground erosion problems and water seepage problems in the area of the downspout. Further, the eaves troughs must be horizontally inclined in order to convey the water to the downspout and this change in elevation of the eaves troughs relative to the roof line also adversely effects the appearance of the building. In addition, the eaves troughs and downspouts tend to collect foreign debris and become clogged and, moreover, since they carry water, they are subject to rust and corrosion.

SUMMARY OF THE PRESENT INVENTION

It is the object of the present invention to overcome the disadvantages of the prior roof drain systems by providing a roof drain system that disrupts the water flowing from the roof into droplets and distributes the droplets in a relative wide band outwardly of the roof line of the building.

Accordingly, the present invention provides an elongated air duct at the lower edge of the roof line arranged to have water from the roof pass thereover, a blower means communicating with the air duct for supplying air under super atmospheric pressure thereto, and aperture means along the length of the duct for passing air from the duct in jets having a substantial component laterally outwardly of the building to substantially disrupt the stream of water as it flows from the roof over the air duct and thereby distribute the water in the form of droplets over a wide band outwardly of the roof line of the building. The air duct is advantageously formed with a lip that extends therealong and overlies the apertures to deflect the water away from the apertures to not only prevent the water from flowing into the duct when the blower is not operating, but to also provide a channel at the underside of the lip through which the air from the apertures can flow laterally to more evenly disrupt the stream of water as it flows from the roof.

Automatic means are advantageously provided for operating the blower when it rains and the blower is preferably of the multiple speed type to supply air to the duct at different rates in accordance with the different rates at which the rain is flowing off the roof.

These, together with other objects, features and advantages of the invention will be more readily understood by reference to the following detailed description when taken in connection with the accompanying drawings wherein:

FIG. 1 is a perspective view of the building having the roof drain system applied thereto;

FIG. 2 is a perspective view of a portion of the air duct for the roof drain system:

FIG. 3 is a transverse sectional view through a portion of the roof and air duct;

FIG. 4 is a fragmentary transverse sectional view through the air duct showing the parts on a larger scale than FIG. 3; and FIG. 5 is a schematic diagram of an automatic control apparatus for the roof drain system.

The roof drain system of the present invention is generally adapted for use on buildings to handle the rain water draining from the roof of the building and is shown in FIG. 1 applied to a building B having a roof R inclined downwardly for drainage and terminating at an eave at its lower edge. The roof drain system in general includes an elongated housing designated generally by the numeral 10 which is attached to the building to extend lengthwise of the lower edge of the roof at a location to have the rain water from the roof flow thereover. As shown, the housing 10 is attached to the building at substantially the same location where the eaves troughs are customarily attached, except that the housing 10 need not be sloped in the direction of its length for drainage as is conventional with eaves troughs. Instead, the housing 10 is mounted to extend horizontally and parallel to the roof line. The housing 10 forms an elongated air duct that extends along the lower edge of the roof and is closed at its ends as by end caps 11. The housing is conveniently formed with a flat rear wall 12 adapted to extend parallel to the facia board *f* on the lower edge of the roof; an upper wall 13 that is preferably inclined downwardly and outwardly from the upper edge of the rear wall; a front wall 14 and a bottom wall 15. The housing can be formed of any suitable material such as sheet metal or plastic and can be formed in any desired manner, for example by shaping or forming from flat sheet stock or by extrusion. In the embodiment shown, the rear wall 12 of the housing is formed separate from the remainder of the housing and the top and bottom walls are formed with channels for receiving opposite edges of the rear wall to form an enclosed duct therewith. As best shown in FIG. 3, the housing is attached to the building as by fasteners 16 such as nails, screws, or the like and is located so that the upper wall 13 of the housing underlies for lower edges of the roof to have the water from the roof flow thereover.

The water from the roof passes in a sheet over the top wall of the housing and provision is made for discharging streams of air from the housing along the length thereof to disrupt the sheet of water as it passes over the housing and distribute the water in the form of droplets over a relatively wide band outwardly of the roof line. As best shown in FIGS. 2–4, the aperture means 18 are located in the top wall 13 of the housing adjacent the outer edge thereof. The aperture means 18 are preferably in the form of a multiplicity of small holes arranged in a row along the length of the housing and spaced sufficiently close together to have the air streams issuing therefrom substantially uniformily disrupt the stream of water flowing over the top wall. For example, a row of openings having a diameter of the order of 0.040 inches and spaced 0.125 inches apart has been found suitable. The housing 10 is advantageously formed with a lip 21 that extends lengthwise thereof above the aperture means 18 to deflect the stream of water from the roof outwardly of the apertures, and thus prevent the water from flowing into the apertures when the air duct is not under super atmospheric pressure. Prefereably, the outer edge of the lip 21 is spaced laterally inwardly from the lower edge of the top wall 13 so that the sheet of water flowing over the lip will normally cascade against a portion of the top wall that is below the lip and the apertures 18 are located closely adjacent the under side of the lip so as to direct air into the pocket formed at the under side of the lip as best shown in FIG. 4.

The front wall 14 of the housing can be formed of any suitable shape and is herein shown in the form of a generally flat upright wall, it being understood that the front wall could be transversely curved or shaped to simulate molding, if desired. The top wall 13 of the housing is advantageously made convex to enhance its strength. A longitudinally extending drip bead 23 is preferably provided at the juncture of the front wall 14 and bottom wall 15 so that any water that flows down the front wall will drip from the bead 23, instead of flowing backward along the bottom wall.

A blower 31 driven by a motor 36 has its outlet 31*a* connected through a pipe or conduit 32 that communicates with the interior of the air duct housing 10 through an opening 33, to supply air under above atmospheric pressure to the duct for flow through the apertures 18. The blower 31 is preferably of the centrifugal type and is arranged to deliver air to the air duct housing at a rate and at a super atmospheric pressure such that the air jets or streams issuing from the apertures 18 in the air duct will disrupt the stream of rain water flowing over the air duct and disperse the same in the form of droplets over a relatively wide band outwardly of the roof line. The volume of air required will vary with the overall length of the eaves and hence the overall length of the air duct housing on the building. In addition, it is contemplated that the air pressure in the duct system can be varied to increase the rate and velocity at which the air issues from the aperture means 18, to adapt the roof drain system to disperse different volumes of water flowing from the roof. For example, a super atmospheric pressure of 2-½ ounces per square inch may be sufficient for light and moderate volumes of water but higher pressure such as 4-½ ounces per square inch may be desired for higher volumes of water. A single blower can be used for many buildings and, as shown in FIG. 1, the blower 31 has its outlet 31*a* connected through one conduit 32 to the air duct housing 10 at one side of the building and through a branch conduit 32*a* to the air duct housing 10 at the other side of the building. It is also contemplated that plural blowers can be used on a building to supply air to different sections of the air duct housing. In order to adapt the roof drain system to efficient handling of different rates of rain fall, a multiple speed blower is advantageously used. For example, the blower 31 can be selected so that it will maintain a preselected pressure such as 2-½ ounces per square inch above atmospheric pressure in the air duct housing at one motor speed and to maintain a relatively higher pressure such as 4-½ ounces per square inch above atmospheric pressure at a second higher motor speed. The rate and velocity of the air stream as it issues from the apertures 18 will obviously increase at the higher pressure in the duct and will aid in distributing the relatively higher volume of water that occurs in heavy rains.

The blower motor can be controlled manually under the control of a switch mechanism 38 having a manually operable controller 38*a*. As shown, the controller 38*a* is selectively movable from an off position 0, to a low L and a high H position. A control system can also be provided to automatically operate the blower when it rains. As diagrammatically shown in FIG. 5, a rain sensor 41 is provided to sense when it is raining and is operative through a control apparatus 42 to actuate either a low speed relay 43 or a high speed relay 44 which controls operation of the blower motor 36. Various different types of rain sensing apparatus can be utilized and the rain sensor may, for example, be of the conductivity type. As shown in FIG. 2, sensor 41 includes an insulating board 48 having a plurality of electrodes designated 49*a* – 49*d* mounted thereon and normally insulated from each other. The rain sensor is conveniently mounted on the top wall of the air duct housing 10 at a location to have the water from the roof flow thereover, and the water forms a conduction path between the several electrodes. The resistivity between adjacent electrodes will vary correlative with the amount of water flowing thereover and the control apparatus 42 is arranged to respond to this change in resistivity between the electrodes to actuate the low speed relay 43 at water flow rates corresponding to light to moderate rainfall and to operate the high speed relay 44 at heavier rates of rainfall.

From the foregoing it is felt that the construction and operation of the roof drain system will be readily understood. The water from the roof flows over the air duct housing and the blower 32 is operated to deliver air to the air duct housing for flow through the apertures 18. The air issuing from the apertures disrupts the water from the roof as it flows over the air duct and distributes the water in the form of droplets in a relatively wide band outwardly of the roof line. The volume of air delivered to the duct and hence the rate in velocity of the air streams issuing from the apertures is advantageously increased for heavy rains to aid in distributing the greater quantity of water that occurs under those conditions.

The roof drain system of the present invention avoids the necessity of providing downspouts and overcomes many of the problems encountered in eaves troughs. In particular, the present roof drain system does not discharge the water from the roof in a concentrated stream as occurs with eaves troughs and downspouts but instead distributes it in the form of droplets in a wide band outwardly of the roof line. This minimizes the problems of erosion that occur when the rain water is discharged in concentrated streams and, moreover, utilizes the rain water to advantage for watering the foundation plantings and lawn. Since the air duct is enclosed, it is not subject to clogging by leaves, dirt, ice or snow. Moreover, since the air duct housing does not collect and receive water, it is less subject to rust and corrosion. Further, the air duct can be mounted to extend horizontally to parallel the roof and does not have to be inclined for drainage as in the case of eaves troughs.

The embodiments of the invention in which an exclusive property or privilege is claimed are defined as follows:

1. A roof drain system comprising elongated housing means defining air duct having an upper wall portion and adapted for attachment to a building to extend lengthwise of at least a substantial portion of the lower edge of the roof whereby rain water from the roof flows over the upper wall portion of the housing means, blower means having an outlet communicating with said air duct for supplying air under super atmospheric pressure thereto, said housing means having aperture means along the length thereof for passing air from the air duct in streams having a substantial component laterally outwardly from the building to substantially disrupt the water as it flows over the housing means and distribute the water in the form of droplets over a wide band outwardly of the roof line of the building, and means for actuating said blower means.

2. A roof drainage system according to claim 1 wherein said housing means includes lip means extending along the housing means and overlying said aperture means to deflect the water flowing over the upper wall portion laterally outwardly of said aperture means.

3. A roof drain system according to claim 1 wherein said aperture means are formed in a downwardly and outwardly slanting wall portion of said housing means and operate to direct the air jets upwardly and outwardly of said housing means.

4. A roof drain system according to claim 1 wherein said aperture means comprises a plurality of small individual apertures arranged in closely spaced relation in a row along said housing means.

5. A roof drain system according to claim 4 wherein said holes have a diameter of about .040 inches and are spaced apart about 0.125 inches.

6. A roof drain system according to claim 1 including means for sensing when it is raining, and means responsive to said sensing means for operating said blower means.

7. A roof drain system according to claim 1 wherein said blower means includes a multiple speed motor for delivering air at a first rate to said housing means at a first motor speed and for delivering air at a second relatively higher rate at a second motor speed higher than said first motor speed, and control means for selectively operating said motor at said different speeds.

8. A roof drain system according to claim 1 wherein said blower means includes a multiple speed motor for delivering air at a first rate of said housing means at a first motor speed and for delivering air at a second relatively higher rate at a second motor speed higher than said first motor speed, means for sensing the flow of water across the roof, and means controlled by said sensing means for operating said motor at different speeds in accordance with different rates of flow of water across the roof.

* * * * *